United States Patent [19]

Livio

[11] 4,072,261

[45] Feb. 7, 1978

[54] PISTOL APPARATUS FOR DRIVING TACKS, NAILS AND THE LIKE INTO MATERIAL

[75] Inventor: Knut M. A. Livio, Varese, Italy

[73] Assignee: Intertack Anstalt, Vaduz, Liechtenstein

[21] Appl. No.: 742,507

[22] Filed: Nov. 16, 1976

Related U.S. Application Data

[63] Continuation-in-part of Ser. No. 593,459, July 7, 1975, abandoned.

[30] Foreign Application Priority Data

July 22, 1974 Switzerland ..... 10029/74
May 29, 1975 Switzerland ..... 6949/75

[51] Int. Cl.[2] ..... B25C 1/04
[52] U.S. Cl. ..... 227/130; 227/136
[58] Field of Search ..... 227/120, 130, 136

[56] References Cited

U.S. PATENT DOCUMENTS

| | | | |
|---|---|---|---|
| 3,099,837 | 8/1963 | Heilman et al. | 227/136 |
| 3,266,697 | 8/1966 | Fiedler | 227/120 |
| 3,826,419 | 7/1974 | Maestri | 227/136 |
| 3,854,648 | 12/1974 | Inzoli et al. | 227/136 |

*Primary Examiner*—Granville Y. Custer, Jr.
*Attorney, Agent, or Firm*—Young & Thompson

[57] ABSTRACT

A piston for driving tacks comprises a magazine that holds a series of tacks preferably interconnected in a strip by individual casings that are detachably interconnected in side-by-side relation in the strip. As the strip advances through the magazine, the casings each containing an individual tack, are severed from the strip by a reciprocating driver which grips and advances the tack and casing and drives the tack, and then retracts to the initial position where the advancing strip forces the empty casing from the driver in the direction of strip advance. The driver has a projection thereon that contacts and ejects this empty casing upon the next advance of the driver. The gun is recocked by pneumatic recoil.

7 Claims, 8 Drawing Figures

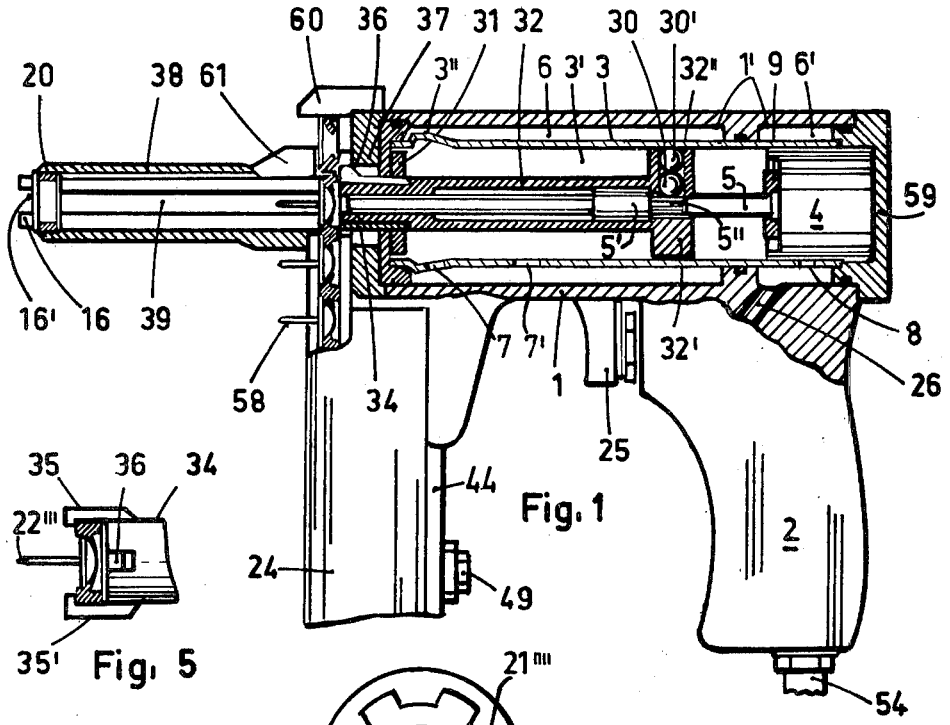
Fig. 1
Fig. 5
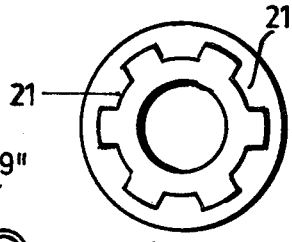
Fig. 8
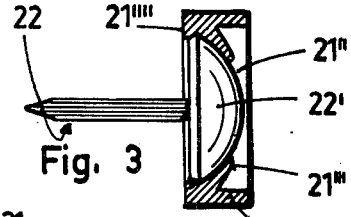
Fig. 3
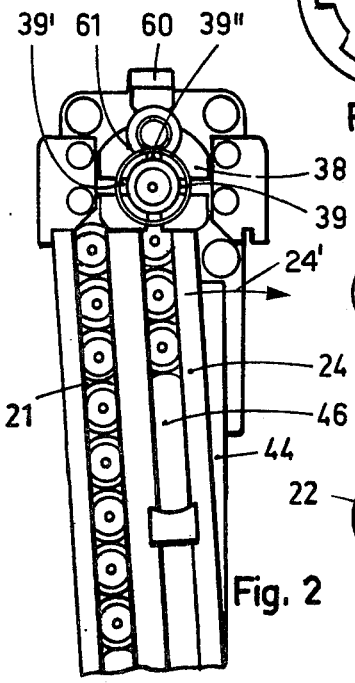
Fig. 2
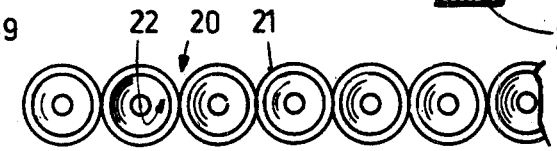
Fig. 4
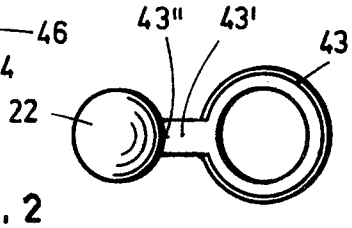
Fig. 7
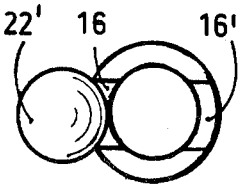
Fig. 6

PISTOL APPARATUS FOR DRIVING TACKS, NAILS AND THE LIKE INTO MATERIAL

This application is a continuation-in-part of copending application Ser. No. 593,459, filed July 7, 1975 and now abandoned.

The present invention relates to pistol apparatus for driving tacks, small nails and the like (hereinafter referred to collectively as "tacks") for decorating and/or laminating materials. The tacks may be used for furniture, suitcases, or for fixing carpets and so on.

Numerous forms of pistol apparatus for driving tacks into materials are known, but these generally have the drawbacks of not being able to protect the head of the tack sufficiently to avoid deformation and of not being adapted to receive small tacks of very diverse dimensions and shapes and of not permitting the use of an elongated barrel; use of an elongated barrel is desirable as it enables the placement of the tacks at points which are of difficult access.

According to the present invention there is provided pistol apparatus for driving in tacks comprising a carrier or magazine adapted to receive at least one set of tacks arranged with their stems parallel and preferably attached to one another indirectly by means of casings each holding a tack, and means adapted to detach a casing and its tack from the set and to cause both to advance along a barrel of the apparatus and to drive in the tack by expelling it from its casing held at the end of the barrel.

Also, according to the present invention there is provided pistol apparatus for driving in tacks comprising a carrier or magazine adapted to receive at least one set of tacks arranged with their stems parallel and preferably attached to one another indirectly by means of casings each holding a tack, means adapted to detach a casing and its tack from the set and to cause both to advance along a barrel of the apparatus and to drive in partially the stem of the small nail into the material, means adapted to expel the casing, and means adapted positively to drive in the small tack or the like into the material.

Preferably, the carrier or magazine is adapted to contain at least two sets of short tacks attached to one another by their casings, said carrier or magazine being hingedly mounted so as to be pivotable between positions of use in which respective sets of tacks can be driven.

Unlike the known pistol apparatus, in the pistol apparatus according to the invention, small tacks with heads of different dimensions and shape can be held inside casings having constant outer diameter or dimensions corresponding to the internal diameter or dimensions of the barrel of the pistol apparatus. The guiding of the small tacks is thus perfect even if the pistol apparatus has a long barrel; furthermore the stems of the small tacks are always disposed axially with respect of the barrel.

An embodiment of the present invention will now be described, by way of example, with reference to the accompanying drawing, wherein:

FIG. 1 shows an elevation, partly in section, of pistol apparatus according to the embodiment of the invention;

FIG. 2 shows the apparatus of FIG. 1 in front view;

FIG. 3 shows a cross-sectional elevation to a larger scale of a casing containing a small tack;

FIG. 4 is a view in plan showing a set of casings joined together;

FIG. 5 is a sectional view in plan of the muzzle end of the apparatus of FIG. 1;

FIG. 6 is a front view of one form of the muzzle end of the apparatus of FIG. 1;

FIG. 7 is the front view of another form of the muzzle end of the apparatus, for use in the apparatus of FIG. 1 in place of the detail of FIG. 6; and FIG. 8 shows in front view, a modified form of casing for an individual tack.

The pistol apparatus shown in FIG. 1 is pneumatically operated and consists of a body 1 provided with a hand grip 2.

Inside the said body 1 is a cylindrical bore 1′ in which is mounted an intermediate hollow cylindrical body 3 having a cylindrical cavity 3′. This body 3 has in its front part a widened, preferably conical portion 3″. The outer periphery of the body 3 is surrounded by chambers 6 and 6′ which are independent and airtight and communicate respectively with the said cylindrical cavity 3′ by means of the bores 7, 7′, and 8. Within this cylindrical cavity 3′ slides a main piston 4, the rod 5 of which is provided with a reduced diameter portion 5″ and an enlarged portion 5′. Against the rod side of the piston 4, is disposed a washer or body 9 of elastic material which serves the function of a shock absorber and partial return spring for piston 4 and rod 5. The rod 5 is slidably mounted axially in a hollow cylindrical sleeve 32 which has in its rear part an enlarged portion 32′ provided with a bore 32″ lying radially with respect to the axis of the said sleeve. Portion 32′ has an internal diameter less than the external diameter of portion 5′. Inside the bore 32″, which opens into the bore of the sleeve 32 and which in the position shown is in alignment with the reduced diameter portion 5″ of rod 5, are two balls 30 and 30′ placed one above the other. These are supported by being trapped between the reduced diameter portion 5″ of the rod 5 and the inner wall of the cylindrical body 3. On the front part of the hollow cylindrical sleeve 32 is mounted a member 34 coaxial with sleeve 32 and provided with two lateral wings 35 and 35′ (FIG. 5), that extend inwards at their front ends and a protuberance 36 in the upper part (FIGS. 1 and 5). The wings 35 and 35′ and the protuberance 36 are adapted to slide in the radial grooves 39, 39′ and 39″, respectively, of the barrel 38 (FIGS. 1 and 2). The rod 5 and the hollow cylindrical sleeve 32 are capable of moving axially through the front end 37 of the body 1. On the hollow sleeve 32 is mounted slidably and axially a body 31 of elastic material, which serves the function of a shock absorber and return spring for portion 32′ and sleeve 32.

Against the free end of the barrel 38 is fixed an interchangeable fitting 16 (FIGS. 1 and 6) having a bore concentric with the axis of the said barrel and an inner diameter adapted to that of the head of the respective small tack to be driven by the apparatus. This part also has radial grooves 16′ (FIGS. 1 and 6) to ensure perfect alignment between the heads 22 of the individual small tacks by supporting the end of the groove 16′ on head 22′ of the small tack, previously inserted, as shown in FIG. 6.

Where the spacing between the tacks driven in is to be greater, the arrangement shown in FIG. 7 may be used. The fitting 43 is used instead of fitting 16, and it will be seen that this fitting 43 has a radial tongue 43′ having a concave end 43'' matched to the shape of the tack head.

Under the barrel 38 of this pistol apparatus there is mounted a carrier or magazine 24 which is perpendicular to the longitudinal axis of the barrel. The magazine is carried on the plate 44 and has a slidable follower 46 (FIG. 2) which is urged by a spring (not shown) to cause the associated set of small tacks to be advanced toward the sleeve 32. The tacks are shown connected to one another with the stems parallel and equidistant, and with each head held in its own casing 21. The casings 21 (FIG. 4) have circular cross sections and are attached to one another tangentially. In addition, the carrier 24 contains two or more sets of small tacks contained respectively in casings 21 preferably attached to one another. After the exhaustion of one set of tacks, the second set of tacks can be presented for use by lateral displacement of the carrier 24 about an axis of rotation defined by connecting stud 49 (FIG. 1) and the tacks of the second set can be used immediately. As seen in FIG. 2, this movement to switch from the first set of tacks to the second, is shown as a swinging movement of the upper end of carrier 24 in the direction of the arrow 24'.

Advantageously, the said casings 21 are made of elastic or flexible material, in particular thermoplastic material. The head 22' of each of the small tacks is of more or less spherical shape and is held by the pressure of a continuous inner and elastic annular edge 21''' (FIG. 3) which pushes it against the front continuous or notched edge 21'''', the latter having an inner diameter slightly less than the outer diameter of the head 22' of the said small tack. It is obvious that whatever the shape of these casings they will have a bore 21'' to permit the passage therethrough of the rod 5 of the piston 4.

In FIG. 8 there is shown a casing 21 having notched edging 21''''. The barrel 38 of the pistol apparatus will have an inner bore of diameter substantially equal to that of the individual casings. It is also possible, although less practical, to make the bore of the barrel 38 of square or rectangular section and to give the casings 21 the same outer shape, to ensure a more secure connection in a set between casings. One of the main advantages of the pistol apparatus described is that it permits of driving in small tacks in places of difficult access such as in complete articles of furniture, since it is possible to make the barrel very long and the small tack is guided by the casing as far as the end of the barrel. This is not possible with the pistol apparatus of most known types, in which the small tacks are not provided with casings.

Other important advantages of the pistol apparatus described consist in that in the act of driving in of the stem of the small tack, the stem is kept accurately perpendicular in relation to the fixing plane, and in that the head of the small tack is efficiently freed from the casing.

A further advantage of the apparatus is shown by the fact that the dimensions of the inner seating of the casings may be varied, keeping their outer diameter, and thereby it is possible to accommodate in respective cases small tacks and ornamental tacks of considerably different configuration as regards shape, diameter, height and curvature of the head 22', and length and section of the stem 22'''. These can all be driven in using the same pistol apparatus which is not possible with the pistol apparatus of known type.

The pistol apparatus described operates as follows:

The pistol apparatus is connected to a source of compressed air through pipe 54. Pressing the trigger 25 causes the compressed air from pipe 54 to pass through the bore 26 of the grip 2 and the bore 8 of the cylindrical body 3, driving the piston 4 forwards. Pushed by the compressed air, the piston 4 shoots forward, displacing in its course stem 5 and in consequence the balls 30 and 30' which are trapped in the reduced part 5'' of the stem 5 and against the hollow sleeve 3 and so the sleeve 32 moves with the piston 4. Advancing of the cylindrical sleeve 32 moves member 34 and the lateral wings 35, 35' of member 34 (FIG. 5) into registry with a casing 21 provided with a small tack (FIG. 5). This casing 21 and its tack are thus forcibly torn off and separated from the set arranged in the carrier or magazine 24. The casing and its tack are thus pushed, until the sleeve 32 reaches the end of its stroke. The point 22 of the small tack will then protrude by about a couple of millimeters beyond the outer face of the interchangeable fitting 16. At this point, the balls 30 and 30', which, during the advance described, slide contained between the inner wall of the cylindrical body 3 and the reduced portion 5'' of the stem 5 preventing the said stem 5 from sliding freely relative to the hollow sleeve 32, arrive at the location of the widened portion 3'' of the cylindrical body 3. On reaching this position, the balls 30, 30' are now free to move radially outwardly and do so due to the reaction resulting from the compressed air thrust on piston 4 thereby enabling the piston 4 and its stem 5 to move freely forward relative to the body 3 and sleeve 32. Thus the stem 5, which is always under the action of the piston 4, is pushed onto the head of the small tack through the cylindrical bore 21'' (FIG. 3) of the casing and drives the tack from the casing into the material, whilst the said casing remains held from further advancement by the inwardly bent ends of wings 35 and 35' (FIG. 5) of the member 34.

During its advance, piston 4 forces air out of cavity 3' through bores 7 and 7' and out into the peripheral chamber 6. Furthermore, the piston 4 moves, during its advance, beyond the bore 7' in the cylindrical body 3, permitting the compressed air to pass out into the peripheral chamber 6 where it is accumulated for the return movement of the piston. By releasing the trigger 25, the air pressure driving the piston is instantaneously vented to atmosphere through the bore 26 and the valve (not shown).

In this forwardmost position of the parts, in which the tack has been fully driven, the bodies 9 and 31 of elastic material are compressed and the air in chamber 6 is also compressed. Body 9 forces the piston 4 back relative to the sleeve 32, thus closing bore 7' and shutting cavity 3' and chamber 6 off from communication with each other. When piston 4 is moved sufficiently to the rear relative to sleeve 32 to permit reduced portion 5'' of rod 5 to register with the bore 32', the enlarged portion 5' of rod 5 will contact the enlarged portion 32' with its relatively small internal diameter, which will drag sleeve 32 to the rear. The balls 30 and 30' are now forced to move back into reduced portion 5'' of rod 5 by the tapered or convergent inner surface of enlarged portion 3'', which acts like a cam to force them into reduced portion 5''. Thus the balls 30' are positively cammed back into reduced portion 5'', after which piston 4 and sleeve 32 with portion 32' are locked together to move to the right to return to the FIG. 1 position of the parts. The air to the rear of piston 4 is vented through bore 26 and the valve (not shown) upon release of the trigger 25 so as not to impede this return movement, the return movement of piston 4 being not only under the spring action of the bodies 9 and 31, but more particularly under the influence of the air compressed in chamber 6, which flows back through bores 7 and 7' for this purpose.

Automatically, the casing 21, now empty, and located between the curved wings 35 and 35' of the member 34 is brought back into its initial position in alignment with the carrier or magazine 24. Under the action of the thrust of the slide 46, the empty casing held between the curved wings of the member 34 is struck radially by the next full casing of the set located in the carrier 24, and is compelled to slide towards the top until it touches the projecting body 60, whilst the full casing which has so pushed it enters between the wings 35 and 35' of the cylindrical body. On re-operating the trigger 25, the advance of the piston 4, of the stem 5, of the hollow cylindrical body 32 and of the member 34 already described, will recur. Whilst the lower part of the member 34 separates the casing containing a small nail held between the two wings of the set located in the carrier 24, the protuberance 36 (FIGS. 1 and 5) of the member 34 will expel the empty casing thrusting it and pushing it forward through the opening 61 (FIGS. 1 and 2) in the barrel 38.

What we claim is:

1. Pistol apparatus for driving in tacks, comprising in combination a magazine adapted to receive at least one set of tacks arranged with their stems parallel and attached to one another indirectly by means of a strip of detachably interconnected cylindrical casings each holding a tack, the pistol comprising a barrel having a bore which has the same internal diameter as the external diameter of the casings, plunger means reciprocable in the barrel means to apply compressed air to the plunger means to reciprocate the plunger means relative to the barrel to detach a casing and its tack from the set and to cause both to advance through the bore and to detach the tack from the casing and to drive in the stem of the tack into material to be tacked, means on the plunger means to retract the empty casing to a position in line with said strip, means to feed the strip into the path of said plunger means whereby the advancing strip pushes said empty casing to a position out of alignment with said barrel, and a protuberance on the plunger means to contact and expel the empty casing of the tack previously driven upon advance of the plunger means to drive the next tack.

2. Apparatus as claimed in claim 1, said magazine containing at least two said sets of tacks attached to one another by their casings in plural rows disposed side by side, said magazine being hingedly mounted so as to be pivotable between positions of use in which respective said rows of tacks can be driven in.

3. Apparatus as claimed in claim 1, wherein each casing has an inner annular elastic edge, which pushes the tack against an outer annular elastically deformable edge having an inner diameter slightly less than the diameter of the head of the tack.

4. Apparatus as claimed in claim 1, in which said plunger means comprises a main piston that is pushed by said compressed air and that has a stem with an enlarged portion and a reduced portion, said enlarged portion being slidably received in a hollow cylindrical sleeve, said empty casing retracting means comprising wings on the front portion of said hollow cylindrical sleeve that extend toward each other, the front portion of said hollow cylindrical sleeve engaging and detaching cases from said set and pushing each casing with its contained tack into said bore of the barrel, the rear portion of said hollow cylindrical sleeve being enlarged to form a second piston which slides in an intermediate hollow cylinder, said second piston having a radial bore therein, retaining balls in said radial bore, the radially inner of said retaining balls being positionable in said reduced portion of said stem, said intermediate hollow cylinder having at its front end a widened portion into which said calls can move radially outwardly to allow said main piston to move relative to said hollow cylinder thereby to permit said stem to drive the tack into the material.

5. Apparatus according to claim 4, wherein the intermediate hollow cylinder is contained in an outer body and defines with this outer body adjacent, independent annular chambers that distribute said compressed air and that communicate with the inside of the said intermediate hollow cylinder by bores through said intermediate hollow cylinder.

6. Apparatus according to claim 4, wherein at the free end of the barrel there is fixed an interchangeable fitting having a bore corresponding to the diameter of the tacks and having thereon a locating portion that is engageable with the head of a tack previously inserted to spaced the following tack at a predetermined position relative to the tack already driven in.

7. Apparatus according to claim 4, wherein said wings and said projection slide in radial grooves of the barrel of the apparatus.

* * * * *